United States Patent [19]

Harada

[11] Patent Number: 4,949,522

[45] Date of Patent: Aug. 21, 1990

[54] ROOFING TILE

[75] Inventor: Shigeru Harada, Aichi, Japan

[73] Assignee: Kabushiki Kaisha Cosmic, Aichi, Japan

[21] Appl. No.: 265,486

[22] Filed: Nov. 1, 1988

[51] Int. Cl.[5] ..... E04D 1/30; E04D 1/24

[52] U.S. Cl. ..... 52/533; 52/535; 52/536; 52/537

[58] Field of Search ..... 52/519, 535, 536, 537, 52/419, 539, 533

[56] References Cited

U.S. PATENT DOCUMENTS

| | | | |
|---|---|---|---|
| 146,140 | 1/1874 | Momenty | 52/538 |
| 607,489 | 7/1898 | Skeele | 52/538 |
| 719,514 | 2/1903 | Schall | 52/538 |
| 787,474 | 4/1905 | Sharp | 52/538 |
| 953,937 | 4/1910 | Arnold | 52/536 |
| 1,237,687 | 8/1917 | Nottebohm | 52/538 |
| 1,370,716 | 3/1921 | Tromm | 52/538 |
| 3,349,534 | 10/1967 | Wotherspoon | 52/555 |
| 3,434,260 | 3/1969 | Carter | 52/538 |
| 4,754,589 | 7/1988 | Leth | 52/538 |

FOREIGN PATENT DOCUMENTS

| | | | |
|---|---|---|---|
| 246389 | 4/1966 | Austria | 52/533 |
| 095420 | 11/1983 | European Pat. Off. | 52/518 |
| 68214 | 4/1893 | Fed. Rep. of Germany | 52/536 |
| 105439 | 12/1899 | Fed. Rep. of Germany | 52/536 |
| 1749 | 12/1900 | Fed. Rep. of Germany | 52/536 |
| 651649 | 2/1929 | France | 52/536 |
| 1376402 | 9/1964 | France | 52/536 |
| 1377121 | 9/1964 | France | 52/538 |
| 252270 | 1/1927 | Italy | 52/536 |
| 21366 | 3/1900 | Switzerland | 52/536 |
| 405136 | 2/1934 | United Kingdom | 52/518 |
| 2141157 | 12/1984 | United Kingdom | 52/518 |

*Primary Examiner*—John E. Murtagh

*Attorney, Agent, or Firm*—Flynn, Thiel, Boutell & Tanis

[57] ABSTRACT

A roofing tile has a platelike but sinuous body which includes an upwardly concave and downwardly convex valley part and an upwardly convex and downwardly concave ridge part, both of which are smoothly, continuously rounded. The valley part and ridge part are located on respective sides of the sinuous body and adjoin one another substantially at the center thereof. A support part located near a first end of the sinuous body projects downwardly from a bottom surface of the valley part and terminates at a downwardly facing bonding surface which is adapted for adhesive bonding directly to a roof. A sidewardly extending wall upstands from a top surface of the sinuous body at the first end thereof, and a sidewardly extending groove is formed in the bottom surface of the valley part adjacent a second end of the sinuous body. The groove is adapted to receive the upstanding wall of another identical roofing tile for adhesive bonding of the wall therein. The sinuous body includes a pair of substantially diametrically opposed engagement surfaces, which are adapted for adhesive bonding to the engagement surfaces of other identical roofing tiles.

5 Claims, 3 Drawing Sheets

ROOFING TILE

BACKGROUND OF THE INVENTION

1. Field of the Invention

The present invention relates to a roofing tile and a method of constructing a tiled roof, more particularly to a roofing tile which simplifies the working process of the construction, to prevent a rain water of a strong wind and rain from entering inside of a house through the fitting parts, to prevent roofing tiles from flying by a strong wind, and to prevent sliding and dropping under construction and after construction, and to guard snow.

2. Prior Art

In prior roofing tiles and methods of constructing a tiled roof, since it has been required to lay a roofing and a cryplomeria bark in turn on an inclined plane of a roof, and furthermore required to fix roofing tiles by filling the lower part of the roofing tiles with a plaster made of clay, an executing work of tiling over is very expensive on account of taking time and requiring a skilled hand, and the intervened clay plaster increases the weight of roof which becomes a remarkable burden on a building body causing the bending of frames of the building.

As a result of an erosion owing to a rain water flowing inside of a house through the fitting portions, gaps are formed in the layer of the clay, still more the leaking of rain is generated.

Furthermore, as cracks and spaces are generated in the layer of clay by a natural weathering after many years the power of fixing and holding of the roofing tiles is gradually decreased, and the weathered parts cause the leaking of rain.

And a fixing method of the conventional roofing tile has fixed by means of nails driven into one point of a bottom side of each roofing tile with leaning on the weight of the roofing tile, but since the roofing tiles have become light in weight lately, a strong wind blows into the space of the fitting portions and blows away the roofing tiles one after another like a chain.

Accidents of the workers and objects slipping down frequently happen under construction and after the construction, because surfaces of the roofing tiles are slippery.

The conventional snow guard tile which is partially disposed on a roof has a defect that the snow guard tile is damaged by the partial concentration of a snow burden, furthermore such a snow guard tile has a defect that damages a roof because a burden on a building body remarkably increases.

SUMMARY OF THE INVENTION

It is therefore an object of the present invention to provide a roofing tile and a method of working enabling to strongly fix and hold roofing tiles after the construction, and to maintain the fixture permanently.

It another object of the invention is to simplify the working process of tiling over.

Is is a further object of the invention to certainly prevent the upstream flow of rain water from flowing inside of a house by strong wind and rain.

It is a still further object of the present invention to provide a snow guard tile able to dissolve a biased burden on a tile roof by plural snow guards formed on all of the roofing tiles which guard not only the heavy snow, but also a little snow. And the snow guards are able to prevent workers and objects from slipping down while working and after the construction.

OPERATION

A fixation of one roofing tile body to another roofing tile bodies, and a fixation roofing tile bodys to a foundation board and a rail board are adhered by adhesives applied on the roofing tiles.

Rain water flowing upstream runs against the projecting wall, water guard units, and jettys of the roofing tile body, then the power of the flow is gradually weakened. And projections of the roofing tile body guard a fixed quantity of snow, and serve the purpose of scaffolding for workers or objects.

Tunnel-shaped gaps divide the rain water flow.

DESCRIPTION OF THE PREFERED EMBODIMENT

Figure 1:
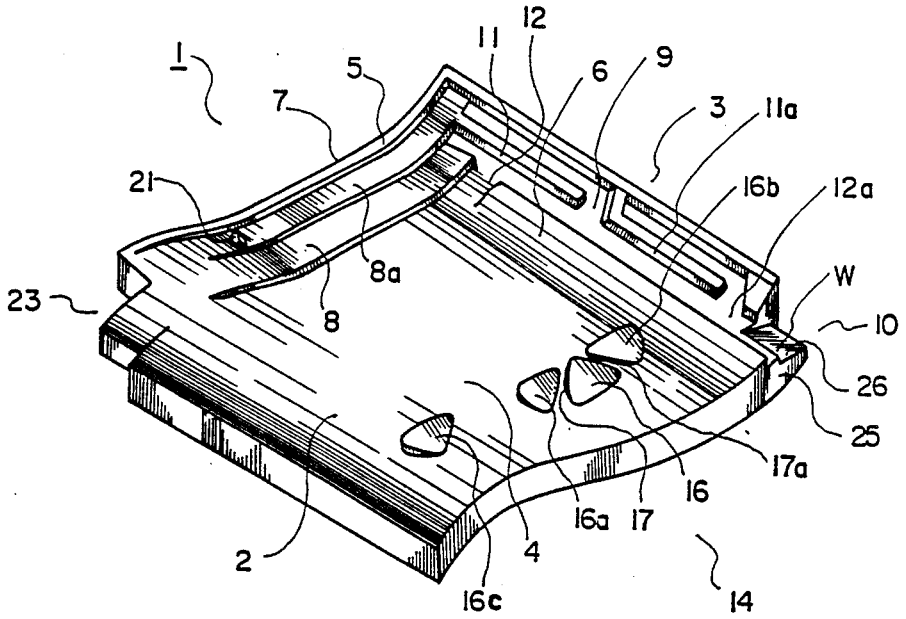
FIG. 1 is a perspective view of a surface of a roofing tile according to the present invention.
Figure 2:
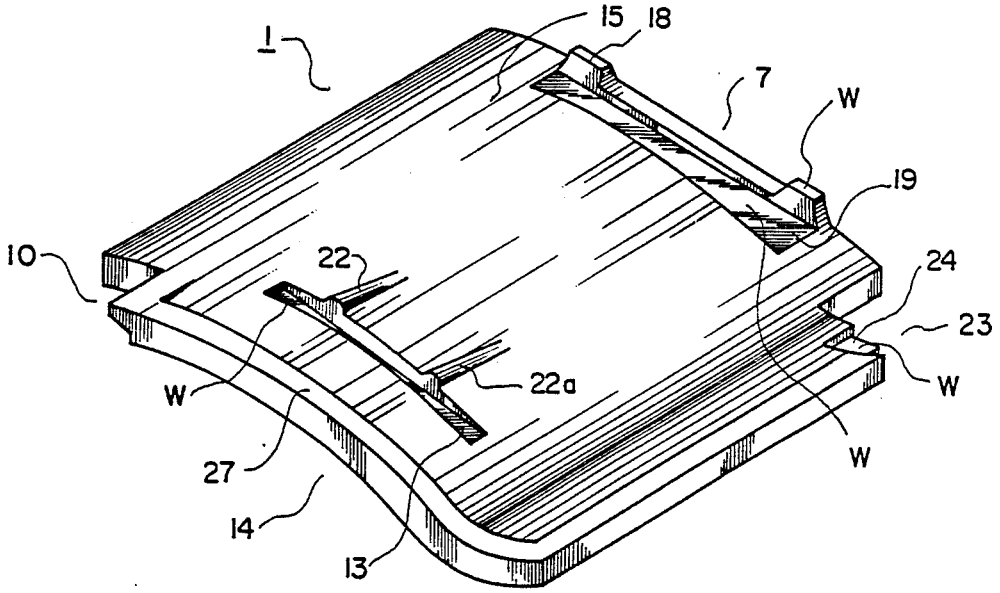
FIG. 2 is a perspective view of a reverse side of a roofing tile according to the present invention.
Figure 3:
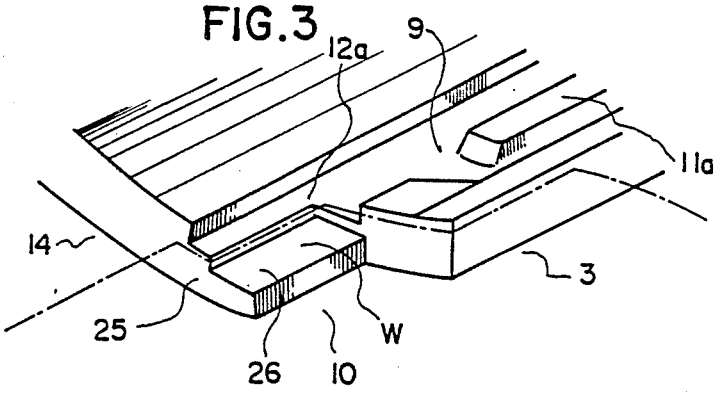
FIG. 3 is an enlarged perspective view of a concerning inclined plane of the roofing tile according to the present invention.
Figure 4:
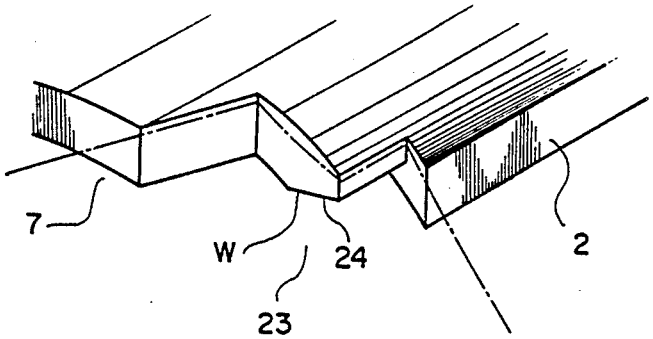
FIG. 4 is an enlarged perspective view of a concerning inclined plane of the roofing tile according to the present invention.
Figure 5:
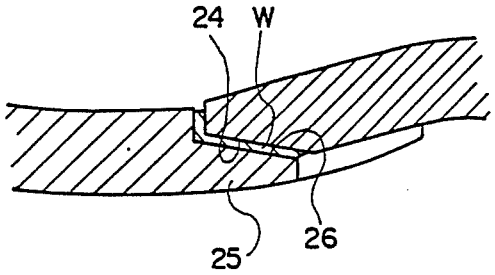
FIG. 5 is a cross sectional view of the concerning inclined planes as joined to each other during assembly of the roofing tiles according to the present invention.
Figure 6:
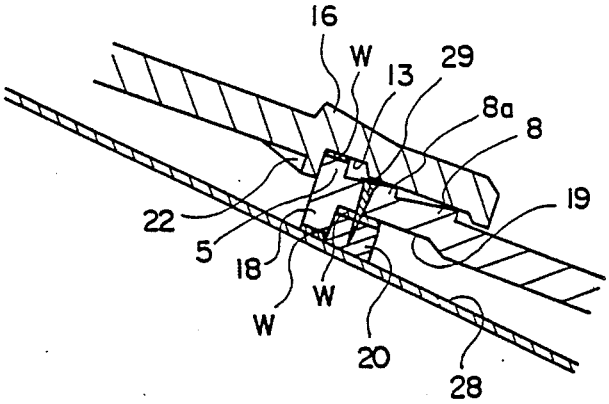
FIG. 6 is an end view which illustrates using a rail unit with roofing tiles according to the present invention.
Figure 7:
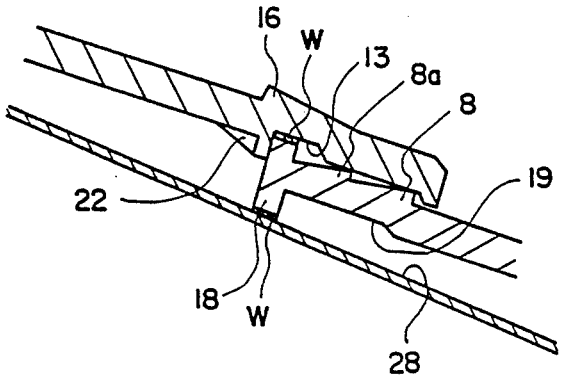
FIG. 7 is an end view of roofing tiles assembled without using a rail unit according to the present invention.

A roofing tile according to the present invention will be described with reference to FIGS. 1 and FIGS. 7.

A roofing tile body 1 is provided with a rail unit 2 projecting and expanding as a substantial arc as viewed in section. A waved valley unit 4 is continuously formed and provided between the rail unit 2 and an insertion unit 3, and the valley unit 4 is wider than the rail unit 2.

A projecting wall 5 is continuously projected from an edge part of a bottom side 7 and an edge of the insertion unit 3 in a surface 6 of the roofing tile body 1.

Water guard units 8, 8*a* are formed in two stepped manner inside of the projecting wall 5 of the bottom side 7 so that its section is sawtooth-shape from the surface 6 of the valley unit 4 to the bottom part of the projecting wall 5, and the bottom part of the water guard units 8, 8*a* is the same height with the surface 6 of the valley unit 4.

A recessed groove 9 provided inside of the projecting wall 5 of the insertion unit 3 is carved with a definite depth so that the height of the basic line of it corresponds to the rising part of the water guard units 8*a* along with the projecting wall 5, and the end parts of the recessed groove 9 extends nearly to a notched postion 10. Jetties 11, 11*a* provided inside of the recessed groove 9 in a straight manner project from the bottom of the recessed groove 9, the one jetty 11 beginning from the base point and another jetty 11*a* beginning from the middle point of the recessed groove 9 respectively so that the jetties 11, 11*a* may line up in two files.

Drain grooves 12, 12*a* discharge the rain water flowing in the recessed groove 9.

A fitting portion or groove 13 provided on a reverse side 15 of a head side or second end 14 in the valley unit 4 is shaped in order to fit on the projecting wall 5 of the bottom side 7, with applied adhesives therebetween.

Projections 16, 16*a* . . . provided on the surface 6 of the head side 14 heave substantially a triangle shape with properly inclining to the head side 14 and are disposed on the surface 6 of the head side 14 and the ridge of the rail unit 2.

The projecting 16, 16*a*, 16*b* on the valley unit 4 form funnel-shaped gaps 17, 17*a*.

A hook unit or support part 18 formed on the valley unit 4 of the bottom side 7 on the reverse surface 15 has the adhesives W applied thereto.

A flat portion 19 making a right angle with the hook unit 18 is confronted with a rail board 20 receiving the roofing tiles, and is secured thereto by the adhesives W.

Furthermore, a nail hole 21 is made as occasion demands, and projections 22, 22*a* project from the head side 14 of the reverse surface 15.

A notched portion 23 formed in two stepped manner makes a right angle with the rail unit 2 of the bottom side 7 of the roofing tile body 1.

A concerning inclined plane 24 is formed on the reverse surface 15 of the valley unit 4 side of the notched portion 23, the adhesives W are applied thereto.

The notched portion 10 making a right angle with the insertion unit 3 of the bottom side 14 of the roofing tile body 1 is provided with a fitting projection 25 on its valley 4 side, and a concerning inclined plane side 26 of the fitting projection 25 has the adhesive W applied thereto.

A weathering unit 27 is continuously formed along the head side 14 of the reverse surface 15 and the rail unit 2.

The connecting side of the flat portion 19 of the roofing body 1 is confronted and fixed to the rail board 20 laid on a foundation board 28 of the roof under construction.

Furthermore a nail 29 is driven in order to fix more strongly as occasion demands.

The adhered surface of the fitting portion 13 and the projecting wall 5 of the bottom side 7 are jointed and fixed at the time when putting a tile upon another tile upward.

Otherwise, when the roofing tiles are tiles over widthwise, the concerning inclined plane 26 of the notched portion 10 and the concerning inclined plane 24 of the notched portion 23 are jointed and fixed.

An operation according to the present invention will be described hereafter.

On tiling over, the fitting portion 13, the hook unit 18 and the flat portion 19 of the roofing tile body 1 respectively have adhesives W applied thereto, and are confronted and adhered to the projecting wall 5, the foundation board 28 and the rail board 20.

The concerning inclined plane 24 of one roofing tile and the concerning inclined plane 24 of another roofing tile 1, and the concerning inclined planes 26 of one roofing tile 1 and the concerning inclined plane 26 of another roofing tile 1 are respectively fitted and adhered by adhesives W applied to the concerning inclined plane 24 and the concerning inclined plane 26 while tiling over.

The projecting wall 5, the water guard units 8, 8*a* . . . and the jetties 11, 11*a* . . . of the bottom side 7 and the insertion unit 3 on the roofing tile body 1 define the water guard passages by the many stepped manner, and then reduce the upstream flow of the rain water in many stepped manner. And the rain water flowing into the recessed groove 9 is drained away through the drain grooves 12, 12*a*.

The projections 16, 16*a* . . . of the roofing tile body 1 guard a settled quantity of snow, and serve as scaffolding for workers and objects while constructing and after the constuction, and the funnel-shaped gaps 17, 17*a* divide the rain water flow.

EFFECT OF THE INVENTION

A constructing method of tile roof according to the present invention enables one to remarkably save working time and cut down expenses by simplifying the working process and by doing without a skilled hand, because of respective fixations of a rail board 20 laid on the foundation board 28 of the road to an adhered portion of a flat portion 19 on a reverse surface 15 of a roofing tile body 1, a projecting wall 5 on a bottom side 7 of a roofing tile 1 positioned lower to an adhered portion of a fitting portion 13 on the head side 14 of the roofing tile 1 positioned upper, a foundation board 28 of a roof to an adhered portion of a hook unit 18 on the reverse surface 15 of a roofing tile body 1, and concerning inclined planes 24, 26 of the bottom and the head side 7, 14 of one roofing tile 1 adhered to concerning inclined planes 24, 26 of the bottom and the head side 7, 14 of another roofing tile.

A roofing tile according to the invention isn't dispersed by the strong wind, and doesn't generate a gap or a shaking, and furthermore enables construction both on a concrete roof without using the rail board 20, and of course by a conventional method too, because of confronting and adhereing the roofing tile bodies 1 each to another, and the foundation board 28 respectively.

A roofing tile according to the present invention can certainly prevent an upstream flow of rain water from entering into a house by strong wind and rain by reducing the water current of the rain water with many stepped water guard units 8, 8*a* . . . and jetties 11, 11*a* . . . of a recessed groove 9, since the roofing tile body 1 is provided with the projecting wall 5 continuously extending along the edge portion of the bottom side 7 and an insertion unit 3 on a surface of the roofing tile body 1, many water guard units 8, 8*a* . . . formed sawtooth-shape or in two stepped manner at its section and rising from a surface of a valley unit 4 near the front of the projecting wall 5 on the bottom side 7 to the basic point of the projecting wall 5 and then the level of the rising point of the water guards units 8, 8*a* . . . being same as the level of the valley surface, the insertion unit 3 provided with the recessed groove 9 at this near front portion, the recessed groove 9 provided with two jetties 11, 11*a* filed and projected in the manner of lining up straightly.

Since the many stepped water guards 8, 8*a* . . . are formed at the inclination according to the pitch of a tile roof, the number of steps are able to be changed without a gap when tiling over.

A roofing tile according to the invention is enabled to stop the sliding of snow and to ensure the function of guarding snow, since projections 16, 16*a* . . . substantially form a triangle shape and are inclined to the head side 14 as well as being provided on the head side 14 on a surface 6 of the valley unit 4 and on the ridge of a rail unit 2 opposite to the fitting portion 13 which is fit with the projecting wall 5 of the bottom side 7 and is provided on the head side 14 and reverse side 15 of the valley 4. The projections 16, 16*a*, 16*b* on the head side 14 on the surface 6 of the valley 4 form funnel-shaped gaps 17, 17*a*. And the roofing tile according to the invention is enabled to lighten a snow burden on roofing tiles by dividing by each tile body 1. And a roofing tile according to the invention is enabled to prevent a rain water from leaking owing to upstream flow through the head side 14, and to strengthen roofing tile bodies because of the funnel-shaped gaps dividing thawed snow or rain water. Since the projections 16, 16*a* . . . are inclined to the head side 14, they don't attract attention and don't spoil the beauty.

Furthermore, the projectins 16, 16*a* . . . serve the purpose by scaffoldings improving the safety of preventing workers and objects from sliding and falling down, and it is possible to improve the snow guard by holding and concerning a bar with projections 16*c* in a cross beam direction and to ensure and simplify the works of providing various apparatuses (for example a solar heat collector) on a roof board.

By the projections 16*c* of the roofing tile body 1 which provided at the top end of a roof, it is possible to construct the ridge without the process of stretching a rope between two ridge-end tiles certainly according to the width of the ridge, and to improve the stability of roofing tiles.

A roofing tile of the invention enables one to save the working time and to do without a skilled hand, because the concerning inclined planes 24, 26 are shaped on the notched portions 10, 23 of the bottom side 7 and the head side 14, a flat portion 19 is shaped in front of a hook unit 18 on the valley unit 4 of the reverse side of the bottom side 7, and the fitting portion 13, the concerning inclined planes 24, 26, the hook unit 18, and the flat portion 19 respectively have adhesives W applied thereto A roofing tile according to the invention is not dispersed by the wind, and doesn't generate a gap or a shaking, enables construction on a concrete roof without the rail board 20 by confronting and adhering to the roofing tile bodies 1 each to another and to the foundation board 28, and enables construction by the conventional art which nails the nail 29 without using the adhesives W.

What is claimed is;

1. A roofing tile, comprising:

a platelike but sinuous body including a continuously smoothly rounded, upwardly concave and downwardly convex valley part, and a continuously smoothly rounded, upwardly convex and downwardly concave ridge part, said valley part and said ridge part being respectively located on a valley side and a ridge side of said sinuous body, said sinuous body terminating in a ridge side edge on said ridge side thereof and in a valley side edge on said valley side thereof, said valley part and said ridge part adjoining one another substantially centrally between said valley side edge and said ridge side edge of said sinuous body;

a support part projecting downwardly from a bottom surface of said valley part and terminating at a downwardly facing bonding surface adapted for engagement against and adhesive bonding directly to a roof, said support part being located near a first end of said sinuous body between said ridge side edge and said valley side edge;

a sidewardly extending wall upstanding from a top surface of said sinuous body at said first end thereof, and a sidewardly extending groove formed in said bottom surface of said valley part adjacent a second end of said sinuous body opposite said first end, said groove being adapted to receive said sidewardly extending wall of another said roofing tile for adhesive bonding of said wall therein; and said sinuous body including means for defining a downwardly facing engagement surface spaced slightly inwardly from both said ridge side edge and said first end, and means for defining an upwardly facing engagement surface spaced slightly inwardly from said valley side edge and adjoining said second end, said means for defining said engagement surfaces including notches formed in said sinuous body where said first end meet said ridge side edge and where said second end meets said valley side edge, said upwardly facing engagement surface being adapted for engagement with and adhesive bonding to said downwardly facing engagement surface of another said roofing tile, and said downwardly facing engagement surface being adapted for engagement with and adhesive bonding to said upwardly facing engagement surface of another said roofing tile, and said sinuous body including a plurality of projections formed on said top surface of said valley part near said second end, said projections each having a first wall which faces and inclines downwardly toward said second end, an adjacent pair of said projections having respective second walls which face each other and define a substantially funnel-shaped gap therebetween which gradually widens as it extends generally in a direction from said first end to said second end of said sinuous body.

2. The roofing tile according to claim 1, wherein said sinuous body includes a further said projection on said top surface of said ridge part near said second end and sidewardly spaced from the remaining said projections, said first wall of each said projection being substantially triangular in shape, at least one of said first walls widening as it inclines toward said second end, each said projection including a third wall which substantially faces said first end.

3. The roofing tile according to claim 2, wherein said sinuous body includes a sidewardly extending flat surface portion adjacent said support part on said bottom surface of said valley part, said flat surface portion being adapted for engagement against and adhesive bonding to a board supported on the roof, said support part being dimensioned such that said bonding surface thereon engages the roof when said flat surface portion engages the board.

4. The roofing tile according to claim 3, wherein said sinuous body includes a further wall upstanding from said top surface and extending along said valley side edge, said further wall adjoining said first-mentioned, sidewardly extending, upstanding wall where said first end meets said valley side edge, said further upstanding wall having an elongate groove extending longitudinally therein and generally facing said ridge side of said sinuous body, and a pair of elongate jetties extending longitudinally along the bottom of said groove and projecting outwardly therefrom, each said jetty having a length slightly less than one-half the length of said elongate groove, said jetties being longitudinally aligned with and longitudinally spaced from one another.

5. The roofing tile according to claim 4, wherein said sinuous body includes a plurality of sidewardly extending raised step portions on said top surface, a first said step portion adjoining said first-mentioned, sidewardly extending upstanding wall, and also adjoining one of said jetties at a location spaced slightly inwardly from where said first end meets said valley side edge, each of the remaining said step portions being spaced a respective distance from said first-mentioned upstanding wall and being respectively downwardly offset from the one of said step portions which is respectively next closest to said first-mentioned upstanding wall.

* * * * *